US006132234A

United States Patent [19]

Waidner et al.

[11] Patent Number: 6,132,234

[45] Date of Patent: Oct. 17, 2000

[54] COAXIAL PLUG CONNECTOR FOR COMMUNICATIONS TECHNOLOGY, IN PARTICULAR IN MOTOR VEHICLES

[75] Inventors: Frank Waidner, Keltern-Niebelsbach; Gabriele Aydt, Niefern-Öschelbronn, both of Germany

[73] Assignee: Wilhelm Sihn, Jr., KG, Niefern-Oschelbronn, Germany

[21] Appl. No.: 09/077,178

[22] PCT Filed: Nov. 20, 1996

[86] PCT No.: PCT/EP96/05119

§ 371 Date: Jul. 31, 1998

§ 102(e) Date: Jul. 31, 1998

[87] PCT Pub. No.: WO97/19496

PCT Pub. Date: May 29, 1997

[30] Foreign Application Priority Data

Nov. 20, 1995 [DE] Germany ..... 195 43 281
Mar. 12, 1996 [DE] Germany ..... 196 09 571

[51] Int. Cl.[7] ..... H01R 13/627

[52] U.S. Cl. ..... 439/358; 439/578

[58] Field of Search ..... 439/350–358, 439/578, 660

[56] References Cited

U.S. PATENT DOCUMENTS 1,552,346 9/1925 Riley .
3,544,951 12/1970 Roberts .
3,694,793 9/1972 Concelman .
4,376,563 3/1983 Margrave .
4,697,859 10/1987 Fisher, Jr. .
4,801,275 1/1989 Ikeda .
4,941,838 7/1990 Zinn ..... 439/350
5,727,963 3/1998 Lemaster ..... 439/358

FOREIGN PATENT DOCUMENTS 0154412 9/1985 European Pat. Off. .
0664578 7/1995 European Pat. Off. .
4100112 12/1991 Germany .

*Primary Examiner*—Khiem Nguyen
*Attorney, Agent, or Firm*—Orum & Roth

[57] ABSTRACT

Coaxial plug connector with snap lock for the communications technology, especially in motor vehicles, comprising a plug (1) which carries a locking device (10) on the outside, and a jack (21) with locking means (27) on the outside surface, whereby, upon completing the plug connection in the direction of the plug-in center line (14), the sleeve (5) of the plug (1) and the outer conductor of the jack (21) on the one hand, and the locking device (10) and the locking means (27) on the other mesh with each other, and, with respect to the inner conductor, contact (6) and mating contact (25x) mesh with each other also. The locking device (10) is a latching spring which is fixed at a location (9) on the housing (2) of the plug (1) in the vicinity of the dielectric bushing (8) and extends alongside the sleeve (5) with at least one finger (12, 13), and at the tip of the fingers (12, 13) has a protrusion (16) which is oriented toward the plug-in center line (14). The fingers (12, 13) extend backward from that location (9) to form levers (18, 19) which can be pushed towards the rear section (3) of the housing (2) causing the fingers (12, 13) to swing elastically outward, and the locking means (27) at the jack (21) are formed by an outer protrusion or by a recess behind which or in which, respectively, the protrusions (16) of the fingers (12, 13) can latch.

31 Claims, 4 Drawing Sheets

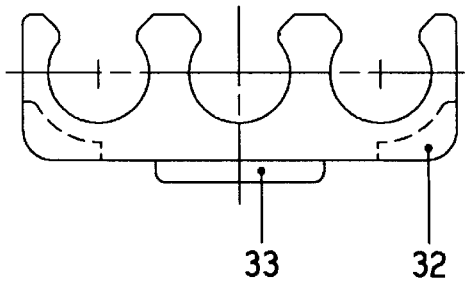
Fig.10
Fig.6
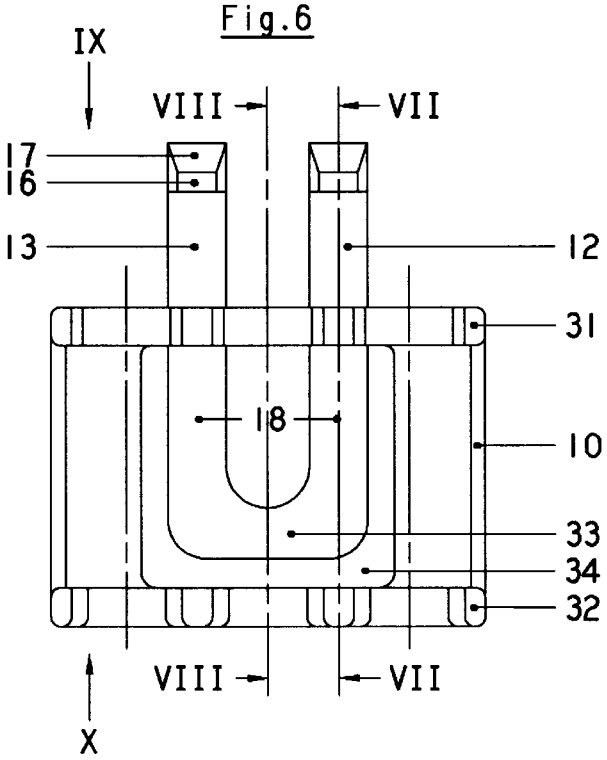
Fig.8
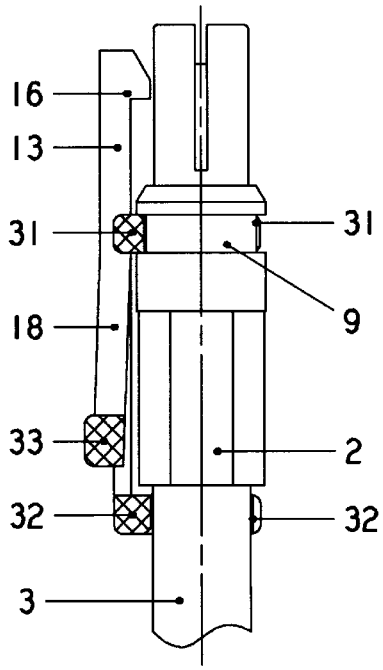
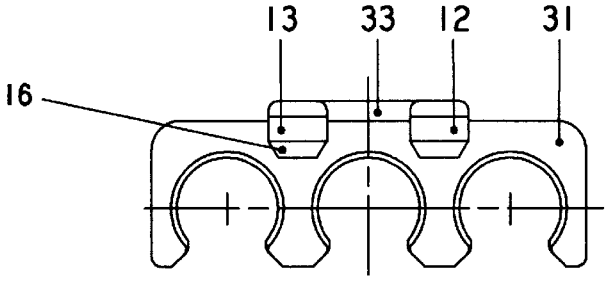
Fig.9

Fig. 12
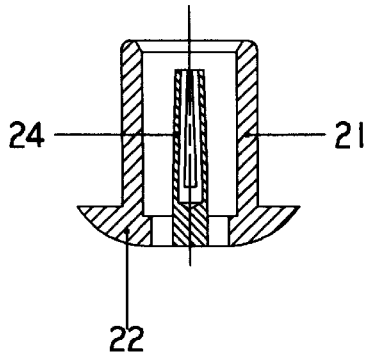
Fig. 14
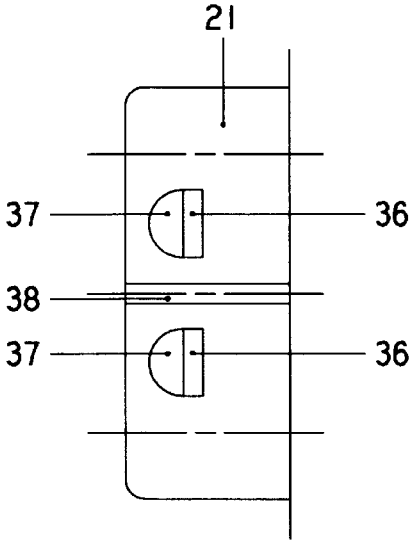
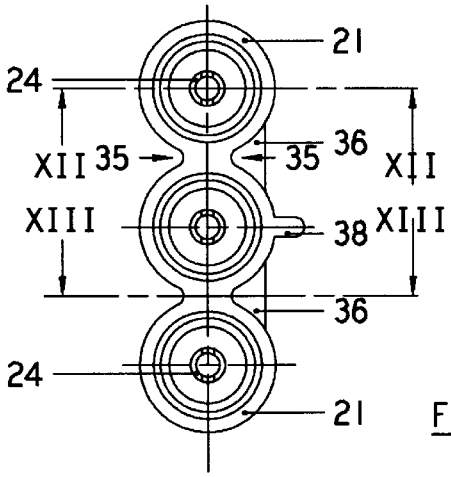
Fig. 11
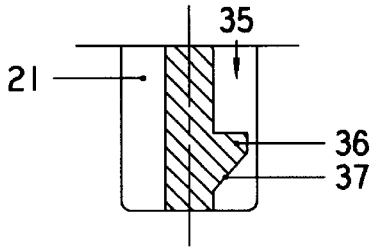
Fig. 13

COAXIAL PLUG CONNECTOR FOR COMMUNICATIONS TECHNOLOGY, IN PARTICULAR IN MOTOR VEHICLES

DESCRIPTION

The invention deals with a coaxial plug connector with the concrete characteristics described in the preamble of claim 1. This kind of plug connector, used in communications technology applications, is known as "IEC-plug connector" (IEC 169-16). The jack of the IEC-plug connector has an outer conductor, also known as a socket, with a conical interior surface which provides a contact area for the longitudinally slotted sleeve of the plug which is pulled into the jack by threading a coupling nut provided on the plug onto the external thread of the jack, while elastically contracting the sleeve of the plug as it is pulled into the socket. This known IEC-plug connector is proven technology. With growing demand for communications technology applications in the automotive sector such as radio receivers, mobile phones, cassette players, CD-players, on-board computers, proximity warning devices, navigation systems, electronic toll collection systems, there is a growing need for coaxial plug connectors which are not only cheaper than conventional ones, but can be miniaturized and easily worked with under cramped working conditions during installation into an automobile.

GB 2 139 018 A discloses coaxial plug connectors with a snap lock which are comprised of a fixed component to be installed on an equipment enclosure, whereby the outer conductor of the fixed component is divided into several segments by longitudinal slots, and whereby these segments have protrusions at their tips with which they are inserted into the outer conductor of a jack which is to be connected with a coaxial cable, and whereby the protrusions latch into a ring groove in the jack. Since the connection can only be unlocked by applying tension, the locking effect of this snap lock is inevitably unreliable.

The object of the invention on hand is to respond to the demand for cheap, easily lockable and unlockable, yet still securely connectable, plug connectors for cabling in motor vehicles.

This object is solved by plug connectors with the characteristics described in claims 1 and 2. Advantageous further developed embodiments of the invention are the subjects of the dependent claims.

In order to be able to comfortably plug and unplug the connection of the plug connector according to the invention, the plug and the jack are not screwed together, as in the case of the IEC-plug connector, but locked together by a latching spring. This latching spring is mounted on the plug housing, preferably retained by a ring groove located on the outside of the plug housing. The retainer ring groove allows the latching spring to rotate around the center line of the plug but not to translate parallel to it. The retainer ring groove is located in the vicinity of the dielectric bushing at the transition between the rear and front sections of the plug. The front section is designed as a sleeve. At least one finger extends from the groove alongside the outer surface of the sleeve. Suppose now that the outer conductor of the jack, also known as a socket, receives the sleeve of the plug; then, the fingers on the outer sleeve surface extend no further than the front edge of the sleeve and can bear on the sleeve by way of their protrusions. As the plug is pushed into the outer conductor of the jack, the fingers are lifted by the outer conductor, slide alongside it, and finally latch behind the provided locking means. If, however, the sleeve of the plug receives the outer conductor of the jack, then the fingers, of which there are at least one, extend alongside the outer sleeve surface and beyond the sleeve's front edge, whereby a protrusion is provided at the end of each finger pointing toward the center line of the plug. As the plug is pushed onto the jack, the projections of the fingers slide along the outside of the jack until they reach a groove or projection, especially a shoulder, on the outside of the jack; as the plug is pushed further onto the jack, the fingers bend outwardly in radial direction as they slide over the shoulder. As soon as the projections of the fingers slide past the shoulder, they snap inwardly in radial direction, thereby locking the connector.

According to the invention, a particularly compact plug connector can be achieved, in contrast to the IEC-plug connector, by having the sleeve of the plug slide over the outer conductor of the jack. When the outer dimensions of the coaxial cable to be connected to the plug are given, the minimum outer dimensions of the plug are essentially fixed, both for the rear section of the plug housing which is installed over the coaxial cable sheath, and for the front section of the plug housing which is designed as a sleeve concentric with the inner conductor pin. In contrast, the jack corresponding with the plug can be miniaturized more easily, especially when used as an equipment connector installed on the housing of an electrical or electronic device; the concept most easily miniaturized, however, is a coaxial plug connector whose jack is to be inserted into the sleeve of a plug.

In order to be able to unlock and separate the plug connector again, the fingers extend backwards beyond the location where the latching spring is retained, preferably a groove, to form levers which maintain a certain distance from the rear section of the plug housing, so that they can be pushed toward the outer surface of the rear section of the housing, which causes the fingers to spread, thereby freeing the latching spring from a recess or a projection, especially a shoulder.

The latching spring is preferably made from a plastic material and manufactured by injection molding. It is retained preferably by a ring or a clamp which snaps into the groove on the outside surface of the plug housing from which the fingers extend in one direction and the levers for actuating the fingers, in the other.

For best results, exactly two diametrically opposed fingers are provided which are actuated by two associated diametrically opposed levers. This arrangement ensures that even under cramped installation conditions, the plug connector can be easily and quickly separated by squeezing and pulling, more easily and quickly than a screwed connection can be unthreaded. There is the additional advantage of the engaged latching spring keeping the plug connector securely locked, in contrast to a screwed connection which can loosen when exposed to the unavoidable vibrations in a motor vehicle. Additionally, the proposed latch connection is cheaper than a screwed connection.

A sufficiently reliable lock between plug and jack can be achieved even with the fingers arranged on one side only. One-sided fingers are particularly useful in an advantageous additional embodiment of the invention, whereby the clamp provided for unlatching the fingers is designed as a multiple connector clamp for holding several plug housings side-by-side. This concept is especially advantageous, because a multitude of coaxial plug connectors can be arranged side-by-side as a connected group. Not only will this bring order in otherwise possible cable tangles, but moreover, the group of plugs connected in this manner can be manipulated in unison, for example, plugged into corresponding jacks by a single hand movement. Locking various plugs and couplers together can be accomplished with a single common part. This embodiment of the invention is advantageous in view of small dimensions, simple handling and inexpensive manufacture. The multiple connector clamp enables the plugs to be held together in a floating manner. Preferably the clamp is a component of a frame or half shell holding the group of plug housings together, whereby the group of plug housings obtains greater rigidity and manipulation in unison becomes easier. In this frame or half shell, preferably not only one but two multiple connector clamps are provided which are spaced a distance apart in the direction of the longitudinal axis of the plug connector; this feature also contributes to easier manipulation of the plugs, and in an advantageous additional embodiment of the invention, enables several fingers to be arranged side-by-side and actuated by a common lever.

A holding device including a latching spring that holds a group of plug connectors together can be manufactured in one piece from plastic material by injection-molding. If it is manufactured to suit double-, triple-, or quadruple clamps, then one can very easily assemble double-, triple-, or quadruple plugs, as required, using a single type of mono-plug.

This type of multiple plug offers the possibility of arranging the locking fingers in a space saving manner, that is, by locating them in the gusset-shaped space between adjacent plug housings, so that the multiple plug with locking means is only slightly thicker than a single plug without locking means. An additional advantage of this embodiment is the fact that the fingers are set in the gusset-shaped space and therefore interfere very little with work in confined cable areas or are in little danger of getting entangled or stuck when pulled into cable harnesses, thereby minimizing the danger of unintentional unlocking. This additional embodiment of the invention is particularly suitable in connection with multiple jacks which are grouped together into a unit, where the gusset-shaped space between adjacent jacks has projections or recesses, where the protrusions on the tip of the fingers can latch positively.

The plug can be attached to the coaxial cable in a well-known manner. For example, the rear section of the housing can be equipped with a self-cutting or even better with a self-grooving thread, so that the plug can be immediately threaded over the coaxial cable sheath. Preferably the rear section of the plug is designed as a crimp sleeve and is connected with the cable sheath by crimping. A crimp connection can be made up faster than a threaded connection and has sufficient pull-out strength for use in motor vehicles. In order to assure adequate electrical contact between the inner conductor of the coaxial cable and the inner conductor pin of the plug, the inner conductor pin is preferably designed as a crimp sleeve also.

Exemplary embodiments of the invention are illustrated in the attached drawings.

FIG. 6 shows the latching spring from FIG. 5 in a bottom view.

FIG. 8 shows Section VIII-VIII according to FIG. 6.

FIG. 9 shows the latching spring viewed in the direction of arrow IX in FIG. 6.

FIG. 10 shows the latching spring viewed in the direction of arrow X in FIG. 6.

FIG. 11 shows in a front view a coaxial triple-jack fitting the group of plugs shown in FIG. 5.

FIG. 12 shows Section XII—XII according to FIG. 11.

FIG. 13 shows Section XIII—XIII according to FIG. 11, and

FIG. 14 shows the triple jack according to FIG. 11, viewed in the direction of arrow 14.

The same or corresponding parts are designated with the same numbers in the various Figures.

Figure 1:
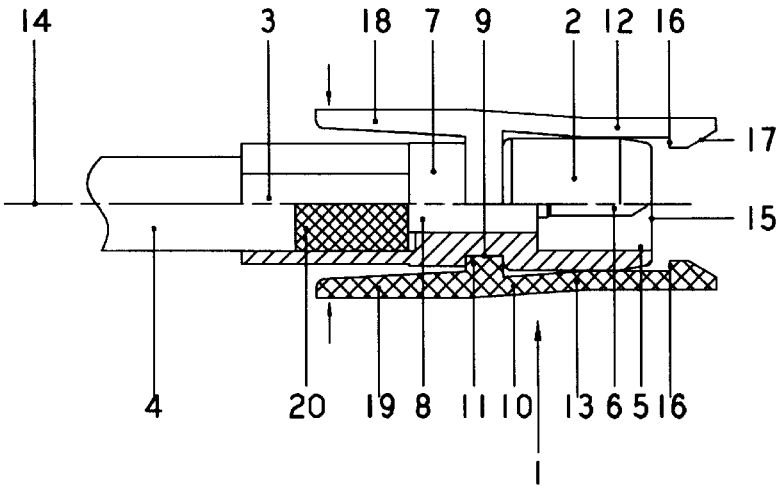
FIG. 1 shows a plug according to the invention, one half in side view and the other half in longitudinal section view.

FIG. 1 shows a coaxial plug 1 whose single-piece housing 2 serves as the outer conductor and has a rear section 3 which is connectable to the coaxial cable 4, and a front section 5 which is designed as a sleeve which, in coaxial arrangement, surrounds contact pin 6 which serves as the inner conductor pin. The pin 6 has a concentric through-hole for receiving the not shown inner conductor of the coaxial cable 4. Located between the rear section 3 and the front section 5 of the housing is a middle section 7 which houses a dielectric bushing 8 in which the inner conductor pin 6 is seated. The outer surface of middle section 7 has a ring groove 9 retaining a latching spring 10. The latching spring 10, made from plastic material and manufactured by injection molding, consists of a ring 11, two fingers 12 and 13, and two levers 18 and 19. The two fingers 12 and 13 extend forward from the ring 11, are diametrically arranged with respect to the center line 14, fit closely alongside the outer surface of the sleeve 5, and in their front section extend beyond the sleeve's front edge 15, where each of the fingers 12 and 13 incorporates a protrusion 16 which is oriented toward the center line 14 and which has a run-up ramp 17 on one side. On the projection lines of fingers 12 and 13, levers 18 and 19, respectively, extend backward from ring 11 and are spaced a distance away from the rear section 3 of the plug housing.

The rear section 3 of the plug housing is designed as a crimp sleeve. In order to connect the plug 1 to the coaxial cable 3, a piece of the cable sheath is removed, thereby exposing the cable outer conductor 20 which, in the shown example, consists of a metal fabric. The cable outer conductor 20 is folded back over the cable sheath and the now exposed cable insulator removed, thereby exposing a piece of the cable inner conductor. The prepared cable end is now inserted into the plug 1 from behind, the rear section 3 of the plug housing is crimped down on the cable sheath and the cable outer conductor 20, and the hollow inner conductor pin 6 is crimped down on the cable inner conductor.

Figure 2:
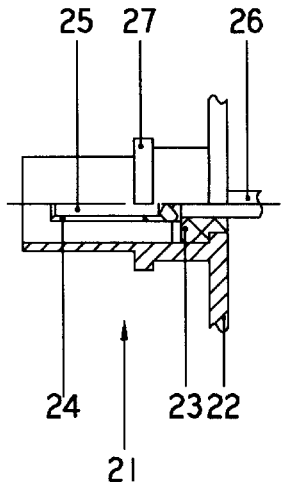
FIG. 2 shows a jack suitable for the plug shown in FIG. 1, one half in side view and the other half in longitudinal section view.

The jack 21 shown in FIG. 2 is depicted as an equipment socket whose single-piece housing is the outer conductor and which is connected with the enclosure wall 22 of the piece of equipment in question. The jack 21 houses a dielectric bushing 23 in which an inner conductor socket 25 with two longitudinal slots 24 is fixed in place. The inner conductor socket 25 is connected with a conductor 26 which leads into the piece of equipment. A ring-shaped shoulder 27 is molded onto the outside surface of the jack 21.

When the plug 1 is connected with the jack 21, the sleeve 5 slides over the outer conductor of the jack 21, while the contact pin 6 is simultaneously inserted into the inner conductor socket 25, thereby expanding the latter elastically. In order to achieve satisfactory electrical contact between the outer conductor of the jack 21 and the sleeve 5, the sleeve 5 should preferably be designed to expand elastically, either by making the sleeve wall sufficiently thin, or by slotting it lengthwise. Alternatively or additionally, satisfactory front-edge electrical contact between the outer conductor of the plug and the outer conductor of the jack 21 can be achieved by providing on each of the protrusions 16 not only a run-up ramp on one side for running up the shoulder, but also a run-down ramp on the other side for running down the shoulder (FIG. 1). During latching, the rundown ramps cause the plug outer conductor to pull up against a stop provided on the jack 21.

Figure 3:
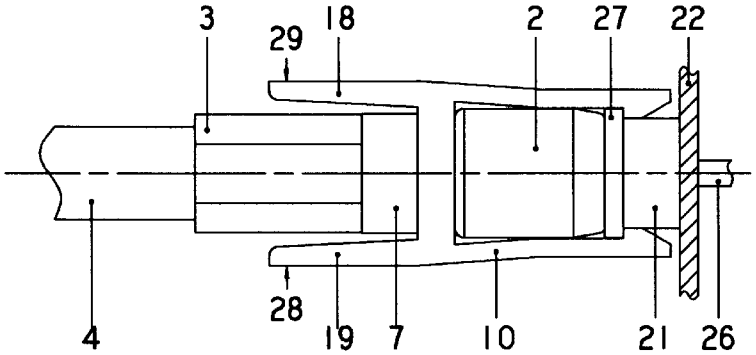
FIG. 3 shows the plug connector in a side view, assembled and mounted to an equipment wall using the components shown in FIGS. 1 and 2.

When connecting, the fingers 12 and 13 run up the shoulder 27 with their run-up ramps 17, thereby spreading outwardly, slide over the shoulder 27 and finally spring inwardly, whereby their protrusions 16 latch behind the shoulder (see FIG. 3). For disconnecting, the levers 18 and 19 are squeezed together in the direction shown by the arrows 28 and 29, causing the fingers to spread outwardly. Subsequently, the fingers are pulled back over the shoulder, whereby the plug 1 as a whole is disconnected.

Figure 4:
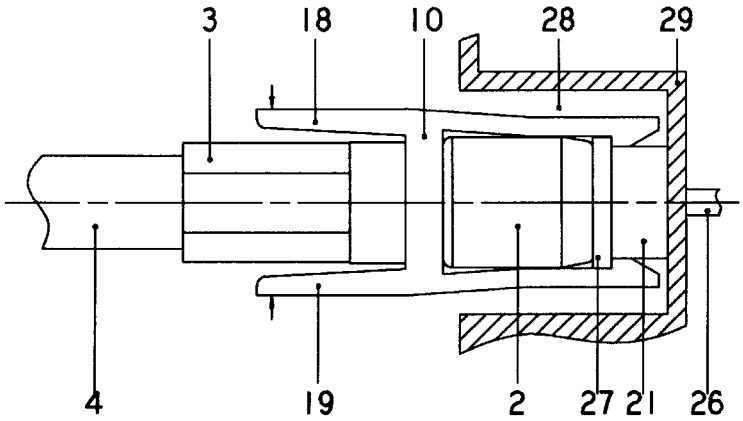
FIG. 4 shows the assembled plug connector in a side view using components shown in FIGS. 1 and 2, with the jack mounted in an equipment wall recess.

The exemplary embodiment shown in FIG. 4 demonstrates a particular advantage of the invention: unlocking the plug 1 by pressing levers 18 and 19 makes it possible to install the jack 21 in a protective recess 28 in the housing 29.

Figure 5:
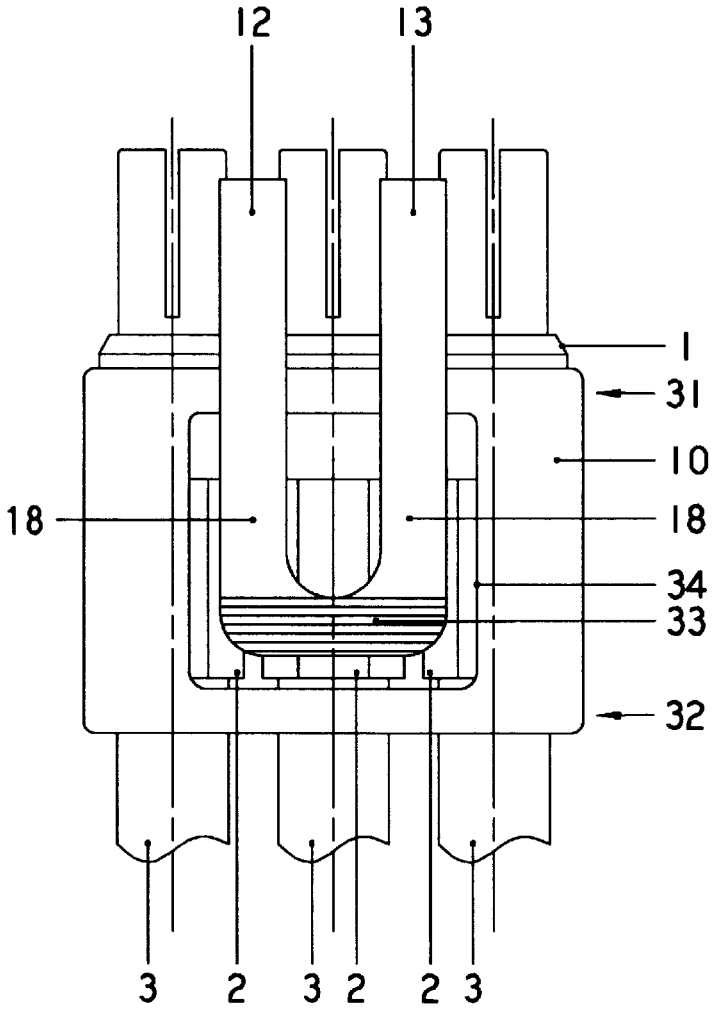
FIG. 5 shows a latching spring with triple clamps for holding three plugs.
Figure 7:
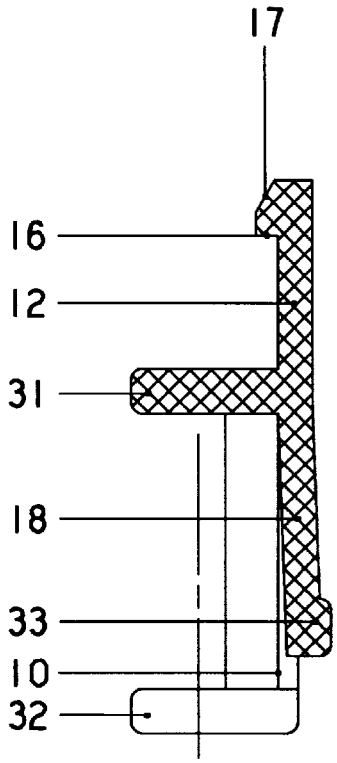
FIG. 7 shows Section VII-VII according to FIG. 6.

Three plugs 1, similar to the ones shown in FIG. 1, can be combined into a triple-plug using a locking device 10 serving all three plugs at once, as shown in FIG. 5. Details of this kind of locking device are shown in FIGS. 5 to 10. The locking device 10 has a frame, which in plan view is approximately rectangular, and has on both of its longitudinal sides two triple-clamps 31 and 32 which hold the three plugs 1 side-by-side in parallel alignment. Triple-clamp 31 is snapped in ring groves 9 of the plugs 1; the other triple-clamp is snapped around crimp sleeves 3 or around the coaxial cables emanating from them. In this manner the locking device 10 combines the three plugs 1 into a manageable unit. In this exemplary embodiment also, the locking device is designed as a latching spring with two fingers 12 and 13 running parallel to each other and extending from that leg of the frame of the locking device 10 which forms the back of the triple-clamp 31. The levers 18 which actuate the two fingers 12 and 13 are connected by a link 33, so that the two fingers 12 and 13 can be actuated in unison by pressing the link 33 which is located in a window 34 provided in the frame.

The corresponding jacks 21 are combined into a triple-jack with a one-component cast outer conductor, as shown in FIGS. 11 to 14. On the one side of the triple-jack and in the gussets 35 formed by adjacent jacks 21, protrusions 36 are provided which do not extend, however, beyond the gussets 35. The protrusions 36 are provided with run-up surfaces 37, where the fingers 12 and 13 run up when connecting the plugs 1 with the jacks 21, until the protrusions 16 on the tips of the fingers 12 and 13 latch behind the protrusions 36 to produce a positive lock.

In contrast to the first exemplary embodiment, in this exemplary embodiment the outer conductor of the jacks 21 receive the outer conductors 5 of the plugs 1. Nevertheless, the construction of the plug connector remains compact, because the fingers 12 and 13 are nested in the gussets 35.

The outer conductor of the triple-jack is preferably a diecast part. The outer conductor of the center jack has a longitudinal ridge 38 which bears the appropriate markings.

What is claimed is:

1. Coaxial plug connector with snap lock for the communications technology, especially in motor vehicles, comprising a plug with an outer conductor of the plug formed by a single-piece housing which, by means of a dielectric bushing, holds a plug inner conductor formed by a contact and behind the dielectric bushing has a rear section for gripping the sheath of a coaxial cable and in front of the dielectric bushing has a sleeve surrounding the contact in coaxial arrangement and on the outside carries a locking device, and a jack with an outer conductor and with a mating contact forming the inner conductor of the jack, surrounded in coaxial arrangement by the outer conductor and fixed in place by a dielectric bushing, and with locking means on the outside of the jack, whereby upon completing the plug connection in the direction of the plug-in center line, the sleeve of the plug meshes with the outer conductor of the jack, and the locking device meshes with the locking means and, with respect to the inner conductor, contact and mating contact mesh with each other also, wherein the locking device is a latching spring which is fixed at a location of the plug in the vicinity of the dielectric bushing and extends alongside the sleeve with at least one finger and at the tip of the fingers has a protrusion which is oriented toward the plug-in center line, wherein the fingers extend backward from that location to form levers which can be pushed towards the rear section of the housing, causing the fingers to seing elastically outward, wherein the locking means at the jack are formed by an outer protrusion or by a recess behind which or in which, respectively, the protrusions of the fingers can latch, and wherein the latching spring has a ring by which it is fixed on the outside of the plug-in housing and from which extend the fingers as well as the levers for actuating the fingers.

2. Coaxial plug connector with snap lock for the communications technology, especially in moror vehicles, comprising a plug with an outer conductor of the plug formed by a single-piece housing which, by means of a dielectric bushing, holds a plug inner conductor formed by a contact and behind the dielectric bushinng has a rear section for gripping the sheath of a coaxial cable and in front of the dielectric bushing has a sleeve surrounding the contact in coaxial arrangement and on the outside carries a locing device, and a jack with an outer conductor and with a mating cotact forming the inneer conductor of the jack, surrounded in coaxial arrangement by the outer conductor and fixed in place by a dielectric bushing, and with locking means on the outside of the jack, whereby, upon completing the plug connection in the direction of the plug-in center line, the sleeve of the plug meshes with the outer conductor of the jack, and the locking device meshes with the locking means and, with respect to the inner conductor, contact and mating contact mesh with each other also, wherein the locking device is a latching spring which is fixed at a location on the housing of the plug in the vicinity of the dielectric bushing and extends alongside the sleeve with at least one finger and at the tip of the fingers has a protrusion which is oriented toward the plug-in cinter line, wherein the fingers extend backward from that location to form levers which can be pushed towards the rear section of the housing causing the fingers to swing elastically outward, wherein the locking means at the jack are formed by an outer protrusion or by a recess behind which or in which, respectively, the protrusions of the fingers can latch, and wherein the latching spring has a clamp with which the latching spring is retained on the outside of the plug-in housing.

3. Plug connector according to claim 1, wherein the sleeve (5) of the plug (1) receives the outer conductor of the jack (2).

4. Plug connector according to claim 3, wherein the locking means (27) at the jack (21) are formed by a shoulder.

5. Plug connector according to claim 4, wherein the latching spring (10) is retained in a ring groove (9) provided on the outside of the plug-in housing (2).

6. Plug connector according to claim 1, wherein exactly two diametrically opposed fingers (12, 13) and two diametrically opposed levers (18, 19) are provided.

7. Plug connector according to claim 2, wherein the clamp (31, 32) is designed as a multiple-clamp in order to receive several plug-in housings (2) side-by-side.

8. Plug connector according to claim 7, wherein the clamp is a part of a frame or a half-shell holding together the totality of the plug-in housings.

9. Plug connector according to claim 8, at the frame or half-shell, respectively, two clamps or multiple-clamps, respectively, are provided which are offset a certain distance in the direction of the longitudinal center line of the plug connector.

10. Plug connector according to claim 7, wherein several fingers (12, 13) are provided side-by-side which are actuated by one common lever (18).

11. Plug connector according to claim 7, wherein the fingers (12, 13) are arranged with respect to the multiple-clamps (31, 32) so that they fit into the gusset-shaped gaps between neighboring plug-in housings (2), and that several jacks (21) are combined into one unit in which the gussets between the jacks (21) contain the protrusions (27) behind which the fingers (12, 13) latch.

12. Plug connector according to claim 11, which wherein the jacks (21) receive the sleeves (5) of the plugs (1).

13. Plug connector according to claim 1, wherein the latching spring (10) consists of a plastic material.

14. Plug connector according to claim 1, wherein the rear section (3) of the housing (2) of the plug (1) is designed as a crimp sleeve.

15. Plug connector according to claim 1 wherein the rear section of the contact pin (6) of the plug (1) is designed as a crimp sleeve.

16. Plug connector according to claim 1, wherein the sleeve (5) and/or the jack (21) are designed spring-like in radial direction.

17. Plug connector according to claim 1, wherein the contact (6) is a hollow contact pin and the mating contact (25) is a longitudinally slotted contact socket.

18. Plug connector according to claim 1, wherein the jack (21) is a socket with a rigid outer conductor.

19. Plug connector according to claim 1, wherein the outer conductor of the jack (21) receives the sleeve (5) of the plug (1) and that the fingers (12, 13) extend no further than to the front end of the sleeve (5) of the plug (1).

20. Plug connector according to claim 1, wherein the sleeve (5) of the plug (1) receives the outer conductor of the jack (21) and that the fingers (12, 13) extend beyond the front edge of the sleeve (5) of the plug (1).

21. Coaxial plug (1) for use in a plug connector with the characteristics contained in claim 1.

22. Plug connector according to claim 2, wherein exactly two diametrically opposed fingers (12, 13) and diametrically opposed levers (18, 19) are provided.

23. Plug connector according to claim 2, wherein the latching spring (10) consists of a plastic material.

24. Plug connector according to claim 2, wherein the rear section (3) of the housing (2) of the plug (1) is designed as a crimp sleeve.

25. Plug connector according to claim 2, wherein the rear section of the contact pin (6) of the plug (1) is designed as a crimp sleeve.

26. Plug connector according to claim 2, wherein the sleeve (5) and/or jack (21) are designed spring-like in radial direction.

27. Plug connector according to claim 2, wherein the contact (6) is a hallow contact pin and the mating contact (25) is a longitudinally slotted contact socket.

28. Plug connector according to claim 2, wherein the jack (21) is a socket with a rigid outer conductor.

29. Plug connector according to claim 2, wherein the outer conductor of the jack (21) receives the sleeve (5) of the plug (1) and that the fingers (12, 13) extend no further than to the front end of the sleeve (5) of the plug (1).

30. Plug connector according to claim 2, wherein the sleeve (5) of the plug (1) receives the outer conductor of the jack (21) and that the fingers (12, 13) extend beyond the front edge of the sleeve (5) of the plug (1).

31. Coaxial plug (1) for use in a plug connector with the characteristics contained in claim 2.

* * * * *